US006286902B1

(12) United States Patent
Yoshimura

(10) Patent No.: US 6,286,902 B1
(45) Date of Patent: Sep. 11, 2001

(54) SEAT BACK FRAMEWORK OF SEAT

(75) Inventor: Masakazu Yoshimura, Akishima (JP)

(73) Assignee: Tachi-S Co. Ltd., Tokyo (JP)

( * ) Notice: Subject to any disclaimer, the term of this patent is extended or adjusted under 35 U.S.C. 154(b) by 0 days.

(21) Appl. No.: 09/458,985

(22) Filed: Dec. 10, 1999

(51) Int. Cl.[7] ..... A47C 7/02
(52) U.S. Cl. ..... 297/452.18; 297/452.2
(58) Field of Search ..... 297/452.18, 452.2, 297/449.1, 452.52

(56) References Cited

U.S. PATENT DOCUMENTS 3,767,261 * 10/1973 Rowland ..... 297/452.52 X
3,995,893 * 12/1976 De La Taille et al. ..... 397/452.2 X
4,796,954 * 1/1989 Saito ..... 297/452.2
4,969,688 * 11/1990 Chinomi et al. ..... 297/452.2 X
5,490,718 * 2/1996 Akizuki et al. ..... 297/452.18 X
5,509,716 * 1/1989 Kolena et al. ..... 297/452.18 X

FOREIGN PATENT DOCUMENTS 227800 7/1990 (JP) .
4125749 11/1992 (JP) .

* cited by examiner

*Primary Examiner*—Peter M. Cuomo
*Assistant Examiner*—Stephen Vu
(74) *Attorney, Agent, or Firm*—Browdy and Neimark

(57) ABSTRACT

A seat back framework of a seat which includes a main frame having two lateral frame sections, a side bracket of a channel cross-section attached to each of the two lateral frame sections, with one end thereof projecting therefrom, and a support wire member extended between the two lateral frame sections, wherein a recession or difference in level is created between that one end of side bracket and one end of the support wire member. In this seat back framework, such one end of the support wire member is welded on and along each of the two lateral frame sections in close proximity to the end of side brackets, thereby reducing or eliminating the foregoing recession or difference in level.

11 Claims, 4 Drawing Sheets

SEAT BACK FRAMEWORK OF SEAT

BACKGROUND OF INVENTION

1. Field of the Invention

The present invention relates to a seat back of a seat in general and more particularly to a framework of seat back of a vehicle or automotive seat.

2. Description of Prior Art

Reference is first made to FIG. 1 which shows a conventional seat back framework adapted for use in such seat back (SB) of vehicle or automotive seat as shown in FIG. 7, for instance.

This framework is generally composed of an inverted-U-shaped main frame (3), a pair of side brackets (2) (2) each being firmly attached to the respective pair of lateral frame sections (32) (32) of the main frame (3), a support wire member (1) fixed at the upper region of the main frame (3) and a lower transverse frame (33). The main frame (3) is formed by bending a tubular rigid material, for example, into the illustrated inverted-U-shaped configuration.

A pair of side brackets (2) (2) stated above are each of the type having a generally channel cross-section, as shown, and welded at the base end thereof to and along the respective two lateral frame sections (32) (32) in the longitudinal direction, such as to project the free end thereof in the direction forwardly of the main frame (3), i.e. from the forward side at (3F), corresponding to the frontal or forward side of seat back (SB) where the back of an occupant sitting on the seat is to be supported, as understandable from FIG. 7. Specifically, as seen in FIGS. 1 and 2, the base end of each side bracket (2) constitutes a rear flange portion (22) of generally channel cross-section adapted to be embracingly attached about the rearward surface (3B) of lateral frame section (22), whereas on the other hand, the free end of side bracket (2) constitutes a forward flange portion (21) which is curved from the body of side bracket in the direction inwardly of the main frame (3), having a similar channel cross-section to that of the rearward flange portion (22). Thus, as shown, the side bracket (2) is firmly attached, at its rearward flange portion (21), about the rearward surface (3B) of main frame lateral frame section (32) by welding.

The support wire member (1) is generally of the shown configuration extending on a linear line, having two end portions (1B') (1B') situated on the same linear line, though the wire member (1) itself is formed uneven in the main body portion (1A) thereof for the purpose of supporting the two headrest stays (S) (S) (See FIG. 7). This wire member (1) extends transversely of the upper region of main frame (3) and is fixed at the two end portions (1B') (1B') thereof to the respective pair of lateral frame sections (32) (32) of main frame (3). As can be seen from FIG. 2, each end portion (1B') of wire member (1) is welded at (10') upon the forward surface (3F) of the corresponding main frame lateral section (32) and disposed above and distant from the projected sheer upper end (21A) associated with the forward flange portion (21) of side bracket (2). Below such support wire member (1), there lies another support wire member (11) of a rectilinear form which also extends transversely of the main frame (3). This wire member (11) is welded at its both ends to the two lateral frame sections (32). Both two support wire members (1) (11) serve to supportively receive the corresponding inner side of upholding (i.e. 4, 5) as can be seen in FIG. 7.

Designations (SH) denote a pair of cylindrical stay holders fixed on the intermediate frame section (31) of main frame (3), in which are to be inserted and secured the two stays (S) (S) of headrest (HD), respectively, as shown in FIG. 7.

The seat back framework may be placed in and covered with a suitable upholding made of a trim cover assembly (5) and a molded foam padding (4), as shown in FIG. 7, so as to form a predetermined seat back (SB) for vehicle or automotive seat.

However, in the present prior-art framework, referring to FIG. 2, due to a spacing (L) provided between the projected upper end (21A) of side bracket (21) and the main frame lateral section (32), there is naturally created a recession or difference in level, at (R), between that particular end (21A) and the end portion (1B') of support wire member (1). Further, such end portion (1B') of support wire member (1) intersects the longitudinal axis of lateral frame section (32) orthogonally therewith, which results in its sheer flat end surface (1B'e) projecting away from the circumferential surface of lateral frame section (32), thus creating a clear-cut recession or difference in level (R) therebetween as well. This in turn causes the drawback that the end portion (1B') itself projects past the frame section (32) to present undesired outward projections on the opposite sides of main frame (3). Hence, as shown in FIG. 3, such recession and projection problems not only render uneasy the covering of the framework with the upholding (5, 4 in FIG. 7), but also cause the foam padding layer (4) of upholding to be caught and scratched at (la) and (lb) by the sheer or sharp ends (1B'e) of support wire member (1) and by the sharp flat upper ends (21A) of side brackets (2), respectively, leaving undesired cuts therein. Furthermore, the aforesaid outward projection of end portions (1B'e) on and from the opposite sides of main frame (3) presses the corresponding lateral portions of upholding intensively, resulting in creation of objectionable protuberant points there, which impairs the outer aesthetic appearance of seat back.

SUMMARY OF THE INVENTION

In view of the above-stated shortcomings, it therefore a primary purpose of the present invention to provide an improved seat back framework which reduces or eliminates the above-noted recession or difference in level between a main frame and a side bracket.

In order to achieve such purpose, a seat back framework of a seat in accordance with the present invention basically comprises:

- a frame means which is formed by bending a tubular material in a generally inverted-U-shaped configuration, the frame means including a pair of lateral frame sections;
- at least one side bracket means of a generally channel cross-section which is fixed to those two lateral frame sections, wherein such at least one bracket means has an end;
- a support wire means which is so provided on said frame means as to extend transversely thereof, which support wire means has a pair of end portions each being disposed on the respective pair of lateral frame sections such as to lie above the end of that at least one bracket means, wherein there is created a recession or difference in level between the frame means and at least one bracket means;

wherein those two end portions of support wire means are fixed by welding to the respective pair of lateral frame sections at a point where both pair of end portions are disposed in proximity to a plane toward which the end of at least one bracket means faces, thereby reducing the recession or difference in level between the frame means and at least one bracket means.

Preferably, the two end portions of support wire means may be both so bent as to orient in a direction to the plane toward which the end of at least one bracket means faces, and the thus-bent pair of end portions be each welded on and along the respective pair of lateral frame sections in a longitudinal direction thereof.

Preferably, the two end portions may be bent at a right angle from a linear line along which the main body of the frame means extends. In this end portions thereof be bent form that main body at a right angle so as to define a curved surface region at that predetermined point.

Other features and advantages of the present invention will become apparent from reading of the descriptions hereinafter, with reference to the annexed drawings.

DETAILED DESCRIPTION OF PREFERRED EMBODIMENT OF THE INVENTION

Referring now to FIGS. 4 through 7, there is illustrated one preferred mode of seat back framework, by way of example, in accordance with the present invention.

Firstly, it should be understood that the seat back framework in the present invention is an improvement based directly upon the previously described conventional seat back framework, using the same parts and members. Thus, most of constituent parts and members of the former are basically identical to those of the latter. All like designations to be used hereinafter correspond to all like designations given in the foregoing description of prior art. Any further repetition of description is deleted about the common parts and members between the prior-art seat back framework and a seat back framework of the present invention to be described hereinafter, for the sake of simplicity.

As understandable from FIGS. 4 to 7, in accordance with the present invention, all the seat back framework construction employed herein and the constituent parts and members thereof are basically identical to those of the conventional seat back framework, with the exception that the support wire member (1) has two end portions (1B) (1B), both of which are oriented in the same direction at a right angle with the rectilinear line along which the uneven main body portion (1A) of support wire member (1) extends, and further the support wire member (1) has a curved surface region (1C) defined at the point where each end portion (1B) is bent from that rectilinear line.

Figure 1:
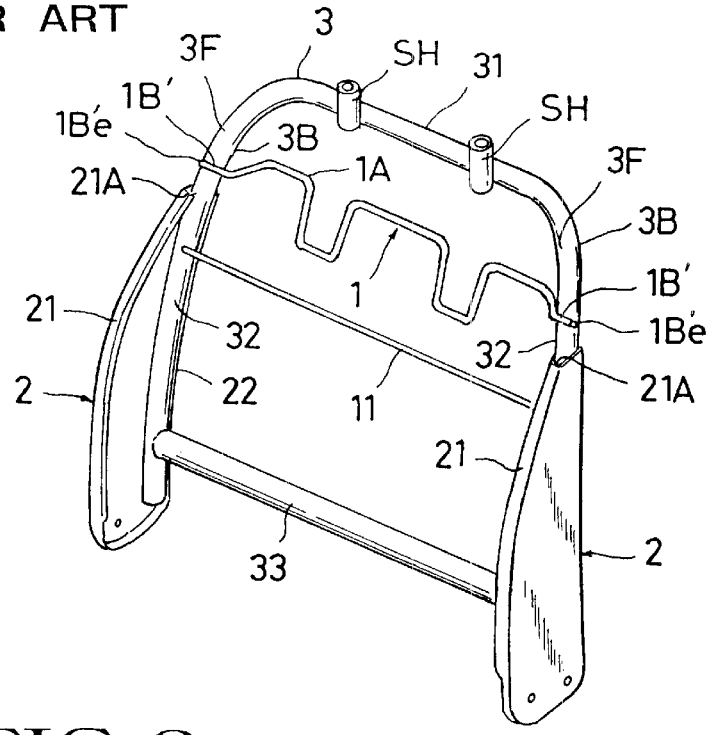
FIG. 1 PRIOR ART
FIG. 1 is a schematic perspective view of a conventional seat back framework.
Figure 2:
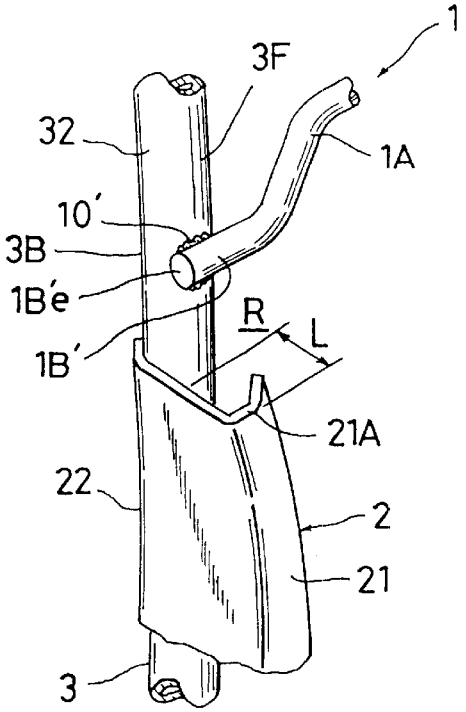
FIG. 2 PRIOR ART
FIG. 2 is a fragmentary enlarged view of a part of the conventional seat back framework in question.
Figure 3:
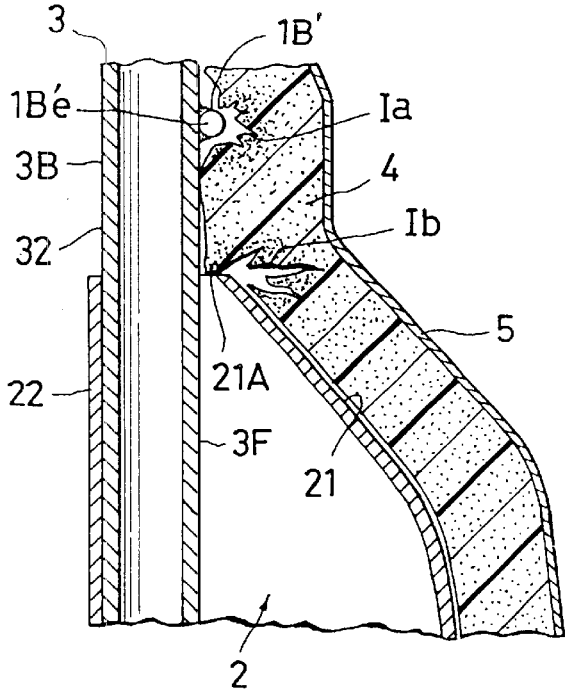
FIG. 3 PRIOR ART
FIG. 3 is a fragmentary sectional view of a seat back having the conventional seat back framework provided therein, showing undesired cuts in a foam padding of an upholstery covering the seat back framework.
Figure 4:
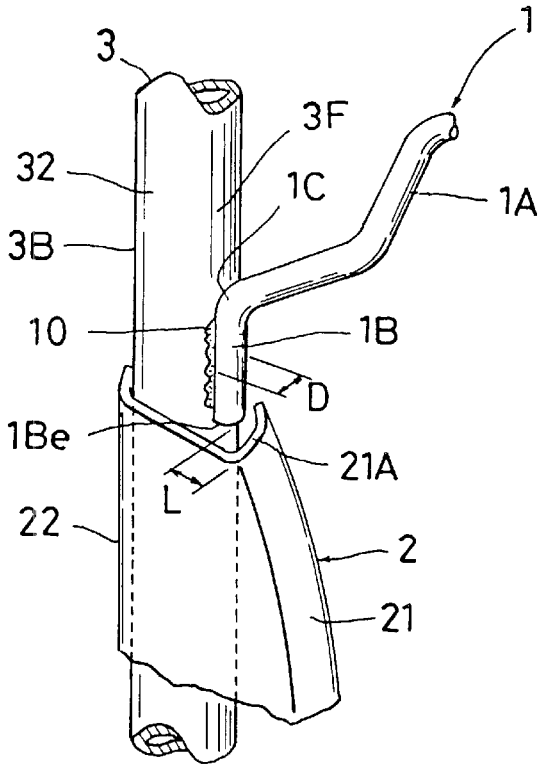
FIG. 4 is a fragmentary enlarged view of principal part of a seat back framework in accordance with the present invention.
Figure 5:
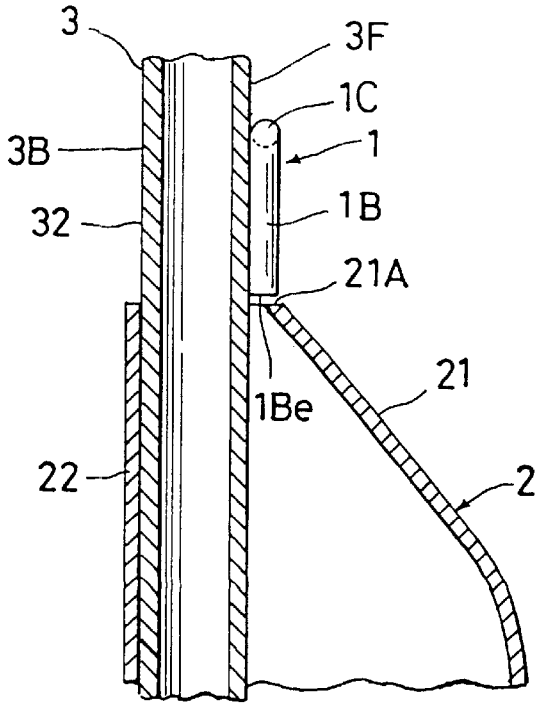
FIG. 5 is a fragmentary longitudinally sectional view of the principal part shown in the FIG. 4.

More specifically, as can be best seen from FIGS. 4 and 5, those two end portions (1B) (1B) are formed by bending an appropriate length of their corresponding end portions of support wire member (1) such as to substantially fill or occupy the recession or difference in level which occurs at (R) in the conventional seat back framework as shown in FIG. 2. Namely, as viewed from FIG. 4, each end portion (1B) of support wire member (1) is so bent at (1C) as to extend downwardly in a required length, taking into account the distance between the bent point at (1C) and the upper end (21A) of side bracket (21). In other words, the bent point (at 1C) corresponds to the location at which is disposed the straight end portion (1B') of support wire member (1) used in the conventional seat back framework, and as such, in accordance with the present invention, bent from that location is the end portion (1B) of support wire member (1) by an angle at which it orients toward a direction along the longitudinal axis of lateral frame section (32), while having a length that compensates for the aforesaid recession or difference in level (R) shown in FIG. 2.

In the illustrated embodiment, the thus-bent two end portions (1B) (1B) of support wire member (1) are each welded (at 10) on the respective pair of lateral frame sections (32) (32) at the given point stated above, as in FIGS. 4 and 5, such that the end surface (1Be) of each of the two end portions (1B) is disposed in close proximity to the end (21A) of side bracket (2). In this respect, it is optional that the end surface (1Be) may be disposed in contact with the side bracket end (21A) in order to completely eliminate the recession or difference in level (R), as may be desired.

Figure 7:
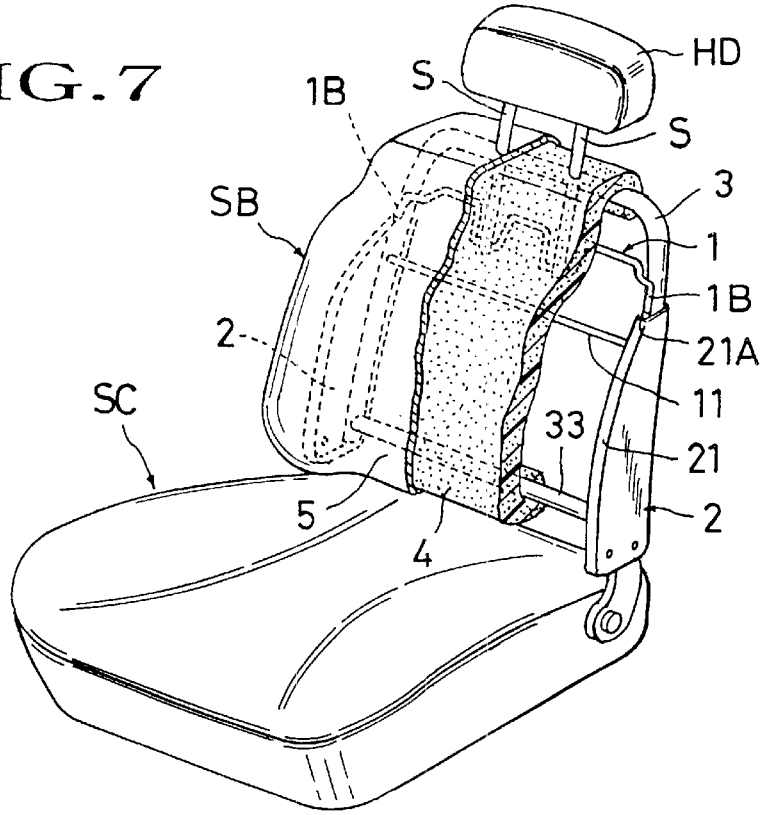
FIG. 7 is a partly broken schematic view of an automotive seat, which shows the seat back framework of the present invention as being provided in a seat back of the seat.
Figure 6A:
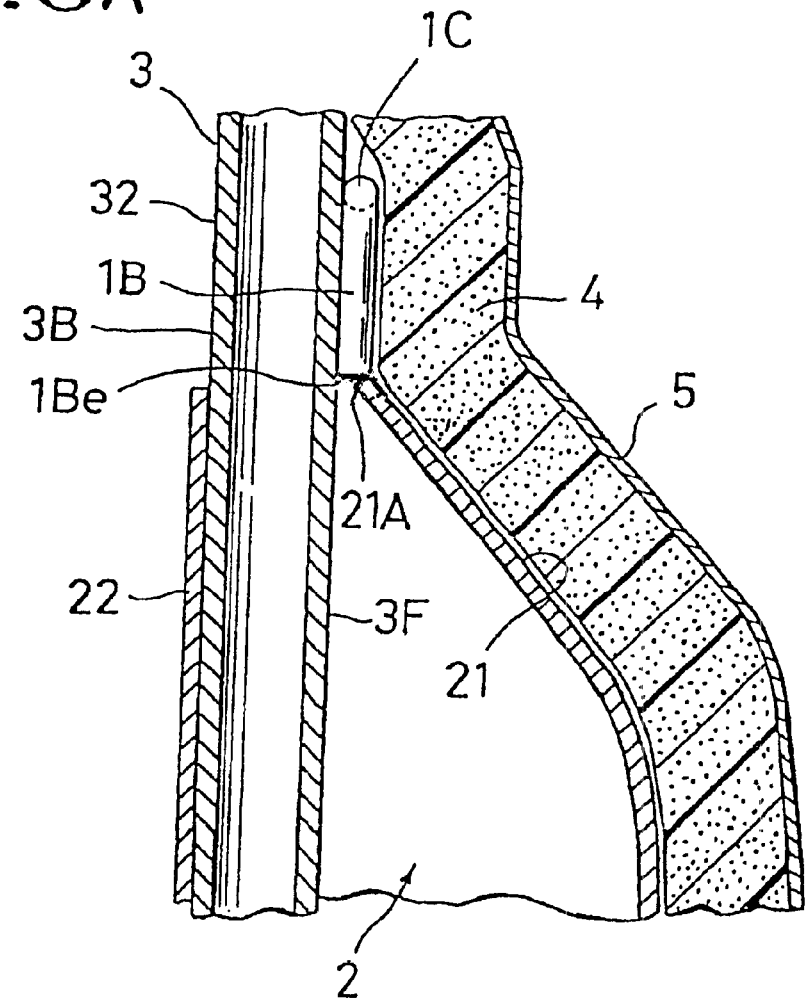
FIG. 6A is a fragmentary sectional view similar to FIG. 6 showing a support wire contacting a bracket.

It is also observed that a curved surface region (1C) is naturally defined at the bent point of the end portion (1B), showing up to provide a smooth, slippery surface as viewed from above with regard to the main frame (3), as in FIG. 7, in contrast to the conventional framework having a straight or horizontal projection of end portion (1B') with respect to the vertical axis of lateral frame section (32). This aspect assists in the easy, smooth insertion of the seat back framework into the inside of the upholstery (4 and 5 in FIG. 7) during the steps of covering the framework entirely with the upholstery.

In this context, it is, of course, preferred to use a support wire member (1) of a circular cross-section. More preferably, the support wire member (1) may have a diameter (D) equal or substantially equal to the distance (L) between the forward surface (3F) of lateral frame section (32) and the projected end (21A) of side bracket (21) with a view to insuring complete elimination of the recession or difference in level (R) found in the prior art.

With the above-described construction, by virtue of the end portion (1B) being welded on and along the lateral frame section (32) in the longitudinal direction thereof, there is reduced or eliminated such recession or difference in level (R) that will catch and cut the inner wall of upholding or the foam padding (4), in this type of framework having the side brackets (2) of generally channel cross-section each embracingly attached to the respective two lateral frame sections (21). In addition, the upholstery (4, 5) can be smoothly affixed over the framework along the main frame (3) without hindrance of the projections found in the prior art. This is indeed effective for an upholstery of the three-dimensional type having an opening at one side thereof, wherein the seat back framework is to be inserted via that one opening into the hollow interior of upholding.

Figure 6:
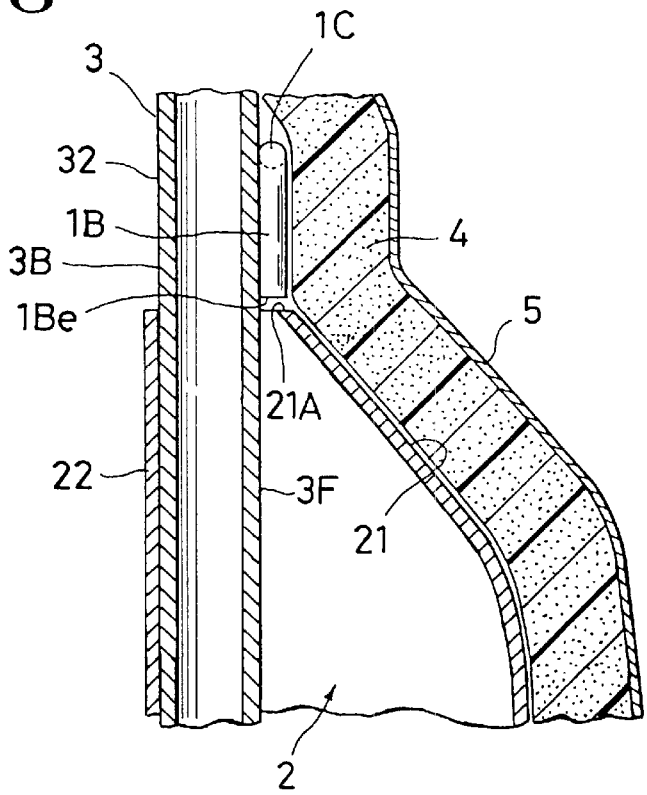
FIG. 6 is a fragmentary sectional view of a seat back in which the seat back framework of the present invention is provided.

FIGS. 6 shows the state where the seat back framework is covered with the upholstery (4, 5), from which it is to be appreciated that the foam padding layer (4) lies neatly on and along both main frame (3) and side bracket (2) without any cut or damaged point therein. FIG. 7 shows a typical automotive seat composed of a seat cushion (SC) and a seat back (SB), wherein the seat back framework of the present invention is applied to the seat back (SB). Designations (HD) and (S) denote a headrest and a pair of headrest stays, respectively.

Moreover, according to the present invention, the end portion (1B) of support wire member (1) is much increased in length in comparison with that (1B') of the prior art, which in turn increases a welding area or amount of the end portion (1B) to the lateral frame section (32), as can be seen from the designation (10) in FIG. 4, whereby the strength in fixing the support wire member (1) to the main frame (3) is enhanced, thereby adding to reinforcement of the seat back framework per se.

While having described the present invention as above, it should be finally understood that the invention is not limited to the illustrated embodiments, but any other modifications, replacements and additions may be structurally applied thereto without departing from the scopes of the appended claims. The seat back framework is not restricted to use in the seat back of automotive seat, but may be applied to any kind of seat having a similar seat back framework.

What is claimed is:

1. A seat back framework of a seat with padding, the framework adapted to support the padding and comprising:

a frame which is formed by bending a tubular material into a generally inverted U-shaped configuration, said frame including a pair of lateral frame sections;

at least one bracket of a generally channel cross-section which is fixed to and along either of said pair of lateral frame sections of said frame, said at least one bracket having an end projected from either of said pair of lateral frame sections; and a support wire adapted to support the padding covering the seat back framework, said support wire being so provided on said frame as to extend transversely thereof and having a pair of end portions each being fixed respectively on said pair of lateral frame sections such as to be in contact with said end of said at least one bracket;

wherein said pair of end portions of the support wire are fixed by welding to the respective pair of lateral frame sections at a point where either end of said pair of end portions is oriented to and disposed in contact with said end of said at least one bracket.

2. The seat back framework as defined in claim 1, wherein said pair of end portions of the support wire are both bent in order to be oriented in a direction to a plane toward which a end of said at least one bracket faces, and wherein the bent pair of end portions of the support wire are each welded on and along the respective said pair of lateral frame sections in a longitudinal direction thereof.

3. The seat back framework according to claim 2, wherein said support wire has a main body extending along a linear line, and wherein said pair of end portions associated with the support wire are bent from said main body at a right angle with said linear line.

4. The seat back framework as defined in claim 1, wherein said support wire has a circular cross-section, wherein said support wire has a main body extending along a linear line, wherein said pair of end portions associated with the support wire are bent from said main body at a right angle with said linear line at a predetermined point, so that a curved surface region is defined in each of said pair of end portions at said predetermimend point.

5. The seat back framework of claim 1, where said pair of end portions of said support wire are fixed by welding to the respective pair of lateral frame sections at a point where said pair of end portions are each oriented to and disposed in a closest possible proximity to said end of said at least one bracket such thatsaid pair of end portions are each contact with said respective ends of said brackets.

6. The seat back framework of claim 1, wherein a diameter of the support wire is substantially equal to a distance between a forward surface of a lateral frame section of said at least one bracket.

7. A seat back framework of a seat with padding, the framework adapted to support the padding and comprising:

a frame which is formed by bending a tubular material into a generally inverted U-shaped configuration, said frame including a pair of lateral frame sections;

a pair of brackets of a generally channel crosssection which are respectively fixed to and along said pair of lateral frame sections of said frame, wherein said pair of brackets each has an end projected from the respective said pair of lateral frame sections; and a support wire for supporting the padding covering of the seat back framework, said support wire being so provided on said frame as to extend transversely thereof and having a pair of end portions each being respectively fixed on said pair of lateral frame sections such as to be in contact with said end of each of said pair of brackets;

wherein said pair of end portions of the support wire are fixed by welding to the respective pair of lateral frame sections at a point where an end of each of said pair of end portions is respectively oriented to and disposed in contact with said end of each of said pair of brackets.

8. The seat back framework as defined in claim 7, wherein said pair of end portions of the support wire are fixed by welding to the respective pair of lateral frame sections at a point where said pair of end portions are each disposed in contact with said end of each of said pair of bracket.

9. The seat back framework as defined in claim 7, wherein said pair of end portions of the support wire are each bent in order to be oriented towards said end of each of said pair of brackets, and wherein the bent pair of end portions of the support wire are each welded on and along the respective said pair of lateral frame sections in a longitudinal direction thereof.

10. The seat back framework according to claim 7, wherein said support wire has a main body extending along a linear line, and wherein said pair of end portions associated with the support wire are bent from said main body at a right angle with said linear line.

11. The seat back framework as defined in claim 7, wherein said support wire has a circular cross-section, wherein said support wire has a main body extending along a linear line, wherein said pair of end portions associated with the support wire are bent form said main body at a right angle with said linear line at a predetermined point, so that a curved surface region is defined in each of said pair of end portions at said predetermined point.

* * * * *